United States Patent [19]

Schroder

[11] Patent Number: 4,878,562

[45] Date of Patent: Nov. 7, 1989

[54] GROUP CONTROL FOR ELEVATORS WITH LOAD DEPENDENT CONTROL OF THE CARS

[75] Inventor: Joris Schroder, Lucerne, Switzerland

[73] Assignee: Inventio AG, Switzerland

[21] Appl. No.: 259,874

[22] Filed: Oct. 19, 1988

[30] Foreign Application Priority Data

Oct. 20, 1987 [CH] Switzerland ..... 04103/87

[51] Int. Cl.[4] ..... B66B 1/22

[52] U.S. Cl. ..... 187/127

[58] Field of Search ..... 187/124, 127

[56] References Cited

U.S. PATENT DOCUMENTS

| | | | |
|---|---|---|---|
| 3,999,631 | 12/1986 | Iwasaka et al. | 187/127 |
| 4,655,325 | 4/1987 | Schroder et al. | 187/127 |
| 4,708,224 | 11/1987 | Schroder | 187/127 X |
| 4,718,520 | 1/1988 | Schroder | 187/127 |

FOREIGN PATENT DOCUMENTS

| | | |
|---|---|---|
| 0050304 | 6/1984 | European Pat. Off. . |
| 0026406 | 8/1984 | European Pat. Off. . |
| 0050305 | 9/1984 | European Pat. Off. . |
| 0062141 | 4/1985 | European Pat. Off. . |
| 0246395 | 11/1987 | European Pat. Off. . |

*Primary Examiner*—William M. Shoop, Jr.
*Assistant Examiner*—W. E. Duncanson, Jr.
*Attorney, Agent, or Firm*—Marshall & Melhorn

[57] ABSTRACT

A group control for an elevator system in which a call firmly assigned to a car, but not serviceable at a stop at the respective floor due to an expected overload, can be serviced subsequently by the same car. For this purpose first and second circuits, assigned to the floors, are provided. A selector scanning the floor and car call memories activates at every position the assigned first and second circuits, where the first circuit causes the car to pass the respective floor if an overload would be generated at a stop. The second circuits assigned to the upward and downward directions are linked to each other in such a manner that, on establishment of an overload, the scanning by the selector of the floor and car call memories assigned in each case to the calls of opposite direction is prevented. After passage of the non-serviceable floor and reaching of the point of return of the direction of travel, the car travels without interruption back to the earlier disregarded floor, whereby the blocking of the scanning of the floor and car call memories of the calls in the opposite direction is cancelled.

8 Claims, 2 Drawing Sheets

GROUP CONTROL FOR ELEVATORS WITH LOAD DEPENDENT CONTROL OF THE CARS

BACKGROUND OF THE INVENTION

The invention relates to a group control for elevators in general and, in particular, to a load dependent control of elevator cars.

A typical elevator group control has call registering devices arranged on the floors, by means of which calls for desired floors of destination can be entered, with floor and car call memories assigned to the elevators of the group, which memories are connected with the call registering devices. Upon the input of calls at a floor, a call characterizing the input floor is stored in the floor call memory and the calls characterizing the floors of destination are stored in the car call memory. The control also includes load measuring devices provided in the cars of the group of elevators, which devices are connected with load memories, first and second selectors assigned to each elevator of the group, exhibiting for each floor at least one position, and a device by means of which the entered calls are assigned to the cars of the group of elevators.

Such a group control is shown in the U.S. Pat. No. 4,718,520 wherein the assignments of the cars to the entered calls can be optimized in time. The car call memory of an elevator of this group control consists of a first memory, already containing assigned car calls, and further memories assigned to the floors in which the calls for desired floors of destination entered at the respective floors, not yet assigned to a car, are stored. A control device, by means of which the entered calls are assigned to the cars of the group of elevators, includes a computer in the form of a microprocessor and a comparison device. Immediately after the registering of a call, the computer calculates, during a scanning cycle of a scanning device at every floor, from at least the distance between the floor and the car position indicated by a selector, the intermediate stops to be expected within this distance and the instantaneous car load, a sum proportional to the loss of time of the waiting passengers at the floors and in the car.

If the first scanners encounter a not yet assigned floor call, the calls entered at this floor for desired floors of destination, stored in the further memories of the car call memory, also have to be taken into account. Therefore, an additional sum proportional to the loss of time of the passengers in the car is established and a total sum is formed. This total sum, also called the cost of operation, is stored in a cost memory. During a scanning cycle of a second scanner following immediately thereafter, the costs of operation of all elevators are compared by means of the comparison device, where in each case an assignment command is stored in an assignment memory of the elevator with the lowest cost of operation, which command designates that floor to which the respective car is assigned optimally in time.

In this group control, an entered call can be assigned to a car almost immediately after the registering of the call. In order to timely signal the assigned car to the passengers waiting on a floor, this type of control can be modified in such a manner that a call assigned for the first time to a car remains assigned to that car, until it is taken over and acted upon by the drive control. Thus, the assignment of a call to be serviced in the future is dependent on the car load existing at the time of servicing, which in this group control can be established based on the registered calls for the desired floors of destination. However, there also exists the possibility that passengers board who have not entered any calls, so that on a subsequent stop due to a fixed assigned call by another passenger, the car could become overloaded.

It is therefore the purpose of the present invention to improve the above described group control in such a manner, that a call assigned to a car will always be serviced by the same car, without the possibility of generating an overload at a stop at the respective floor.

SUMMARY OF THE INVENTION

This problem is solved by the present invention which has first and second circuits assigned to the floors which are activated at every position of the selector. In each case, the first circuit becomes active in such a manner that the car does not service the assigned call if, at a stop on the respective floor, an overload would be generated in the car. The assigned second circuit has the effect that the scanning by the selector of the floor and car call memories assigned to calls in the opposite direction is prevented, so that after passing the respective floor and reaching the point of reversal of the direction of travel, the car will travel back without interruption to the disregarded floor and will service the calls entered there correspondingly.

The advantages attained with the present invention are that, with the proposed subsequent service of an assigned call disregarded because of an unexpected occurrence of overload at the respective floor, the first time assignment of a call to a car can be fixed and final. By the intermediate and interruption free return trip to the disregarded call, there does not result a great loss of time, since time is saved by the passing of the respective floor.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
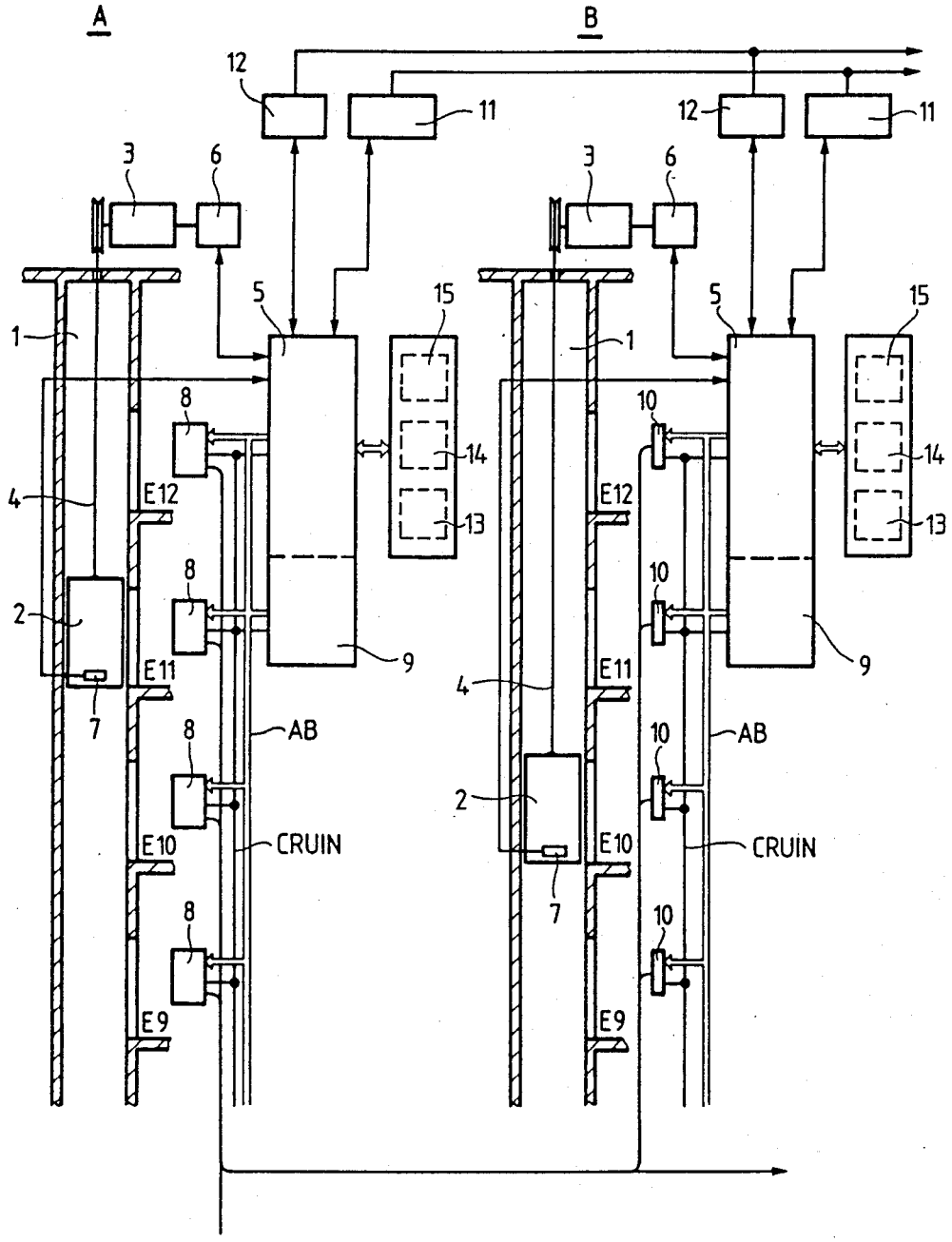
FIG. 1 is a schematic diagram of a group control according to the present invention for two elevators of a group of elevators.

Designated with "A" and "B" in FIG. 1 are two elevators of a group of elevators, wherein each elevator includes a car 2 which is guided in an elevator shaft 1 and is driven by a hoisting machine 3 by way of a conveying cable 4 to service, for example, thirteen floors E0 to E12 (only the top four floors are shown). The hoisting machine 3 is controlled by a drive control, shown in the European Patent No. B 0 026 406, wherein the generation of the setpoint valve, the regulating function and the stop initiation are realized by means of a microcomputer system 5 which is connected with measuring and adjusting elements 6 of the drive control. In addition, the microcomputer system 5 calculates from elevator specific data a sum corresponding to the average waiting time of all passengers, also called operating costs, which is made the basis of the call assignment process. The car 2 includes a load measuring device 7 which is likewise connected with the microcomputer system 5. Provided on each of the floors are call registering devices 8 in the form of ten key keyboards, by means of which floor calls for trips to desired floors of destination can be entered.

The call registering devices 8 are connected by way of an address bus "AB" and a data input conductor "CRUIN" with the microcomputer system 5 and with an input device 9, shown in the European Patent No. B 0 062 141. The call registering devices 8 can be assigned to more than one elevator of the group. For example, those devices 8 associated with the elevator "A" are connected by way of coupling elements in the form of multiplexers 10 with the microcomputer system 5 and the input device 9 of the elevator "B". The microcomputer systems 5 of the individual elevators of the group are connected with each other by way of a comparison device 11 shown in the European Patent No. B 0 050 304 and a party line transfer system 12 shown in the European Patent No. B 0 050 305, and form, together with the call registering devices 8 and the input devices 9, a group control which structurally conforms with a group control described in European Patent Application No. A 0 246 395. In the system 5, designated with 13 is a load memory and with 14 a first circuit for the control of overload in the car 2. A second circuit 15 activates the subsequent servicing of a call disregarded on account of overload. The load memory 13, the first circuit 14 and the second circuit 15 are connected to each other and with the microcomputer system 5 and will be explained in more detail in the following with the aid of the FIGS. 2 and 3.

Figure 2:
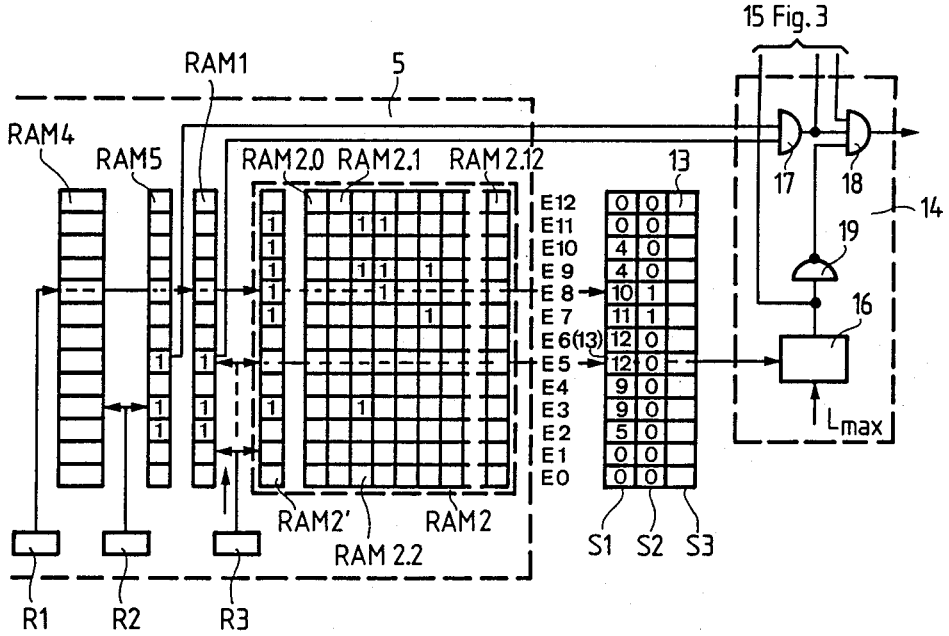
FIG. 2 is a schematic diagram of a load memory assigned to an elevator and a first circuit of the group control according to FIG. 1 for the up direction of travel.

A portion of the microcomputer system 5 is presented schematically in FIG. 2, and includes a floor memory RAM1, a car call memory RAM2, a cost memory RAM4 and as assignment memory RAM5, where only the memories assigned to the upward calls are shown. A first scanner R1 and a second scanner R2, as well as a selector R3, in the form of registers, provide address signals by means of which the storage locations of the memories RAM1, RAM2, RAM4 and RAM5 can be adressed. The car call memory RAM2 consists of a first memory RAM2', which has storage locations corresponding to the numbers of floors, in which already asigned calls are stored. In addition, the car call memory RAM2 includes further memories RAM2.0 through RAM2.12, assigned to the floors E0 through E12 respectively, which likewise have storage locations corresponding to the number of floors, into which the calls entered at the respective floors are transferred, which calls are not yet assigned to a specific car. In this way, according to the example of FIG. 2, calls entered on floor E2 for the floors E3, E9 and E13 are transferred into the further memory RAM2.2, during which simultaneously a call for floor E2 is stored in the floor call memroy RAM1. Corresponding to the customary logic symbolism, the stored calls in the FIG. 2 are characterized by a "1".

According to FIG. 2, the load memory 13 consists of a write-read memory in the form of a matrix which has just as many horizontal lines or rows as floors and three vertical columns S1, S2, and S3. The first column S1 of the matrix is assigned to calls in the same direction of travel and ahead of the car 2, the second column S2 to calls of the opposite direction, and the third column S3 to calls in the direction of travel and behind the car 2. In the storage locations of the load memory 13, load values are stored in the form of a number of persons which, at the departure from or passage by a floor, are present in car 2.

For a more detailed explanation, let it be assumed for the example shown in FIG. 2, that the car 2 is in the course of upward travel in the region of the floor E1 and that upward calls are entered on the floors E2, E3 and E5. After transfer of the calls into the floor call memories RAM1 and further memories RAM2.2, RAM2.3 and RAM2.5, a sum is formed from the number of calls entered at a floor (boarding passengers) and from the number of calls designating this floor as destination of travel (exiting passengers) and is stored as a load value in the load memory 13. The first column S1 of the load memory 13 will therefore display, based on the chosen number of boarding and exiting passengers, the load values evident from FIG. 2. For example, based on each of five boarding passengers on the floors E2 and E3 and one exiting passenger on the floor E3, the load value for the floor E3 is nine.

As described in the preceding, conclusions are drawn in the setting-up of the load memory 13 based on the entered calls as to the future boarding and exiting passengers and thereby the loads in the car 2. However, it is possible that passengers enter their call more than once, or that passengers would board who have not entered a call. In these cases, the stored load values have to be corrected. For this purpose, the load memory 13 is connected with the load measuring device 7 of the car 2 by way of the microcomputer system 5 (FIG. 1). In the first case, so many of the identical calls of destination are cancelled at the respective floor as correspond to the difference between the stored load value and the actually measured car load. After that, all stored load values between the floor of entry or boarding and the floor of destination of the more than once entered call are corrected. In the second case, the stored load values have to be increased where it is assumed that the passenger, who has not entered a call, intends to travel to a destination which is characterized by a call already entered by another passenger. If several calls have been entered, it is assumed that the passenger who has not entered a call desires to travel to the most distant destination.

The first circuit 14, shown in similar form in the European Patet Application No. A 0 199 015, consists of a comparator 16, a first AND-gate 17 having two inputs, a second AND-gate 18 having three inputs and a NOT-gate 19 as shown in FIG. 2. One input of the comparator 16 is connected to the output of the load memory 13, while a load limit value signal $L_{max}$, corresponding to a maximum permissible number of passengers, is fed to the other input. The comparator 16 is connected on the output side with the second circuit 15 (FIG. 3) and, by way of the NOT-gate 19, with one input of the second AND-gate 18. A second input of the second AND-gate 18 is connected to the output of the first AND-gate 17, the inputs of which are connected with the outputs of the respective memory cells of the floor call memory RAM1 and the assignment memory RAM5. The third input of the second AND-gate 18 is connected by way of the second circuit 15 with the selector R3 as will be described in connection with FIG. 3. The output of the second AND-gate 18 is in connection with the drive control of the respective elevator, where the satisfied AND-condition is interpreted as a travel command to the respective floor. The first circuit 14 can be formed by a microprocessor of the microcomputer system 5, based on a program, at any position of the selector R3 for the respective floor.

Figure 3:
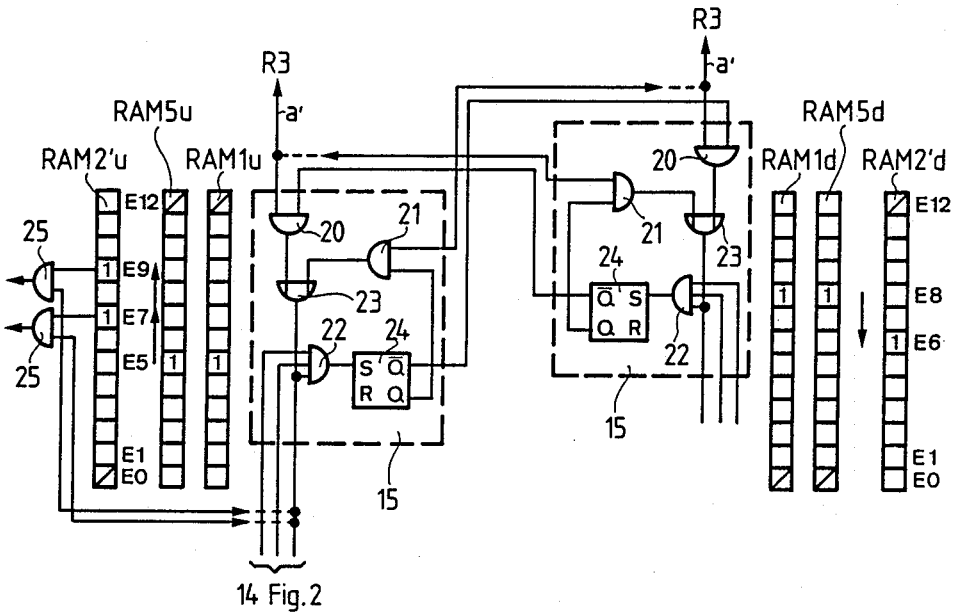
FIG. 3 is a schematic diagram of two second circuits assigned to an elevator of the group control according to FIG. 1.

Designated in FIG. 3 are the floor call memory RAM1, the assignment memory RAM5 and the first memory RAM2' of the car call memory RAM2 designted for upward calls with the letter "u" and for downward calls with the letter "d". Assigned to each memory cell of the floor call memory RAM1u and RAM1d is a second circuit 15. For example, in FIG. 3, each of the second circuits 15 are shown for an upward call to floor E5 and a downward call to floor E8. According to FIG. 3, the second circuit 15 consists of a first AND-gate 20 and a second AND-gate 21 each having two inputs, a third AND-gate 22 having three inputs, an OR-gate 23 having two inputs and an RS flip-flop 24. The first AND-gate 20 has one input connected to an input line a' from the selector R3 and an output connected to one input of the OR-gate 23. The second input of the OR-gate 23 is connected to the output of the second AND-gate 21, and the output of the OR-gate 23 is connected to one input of the third AND-gate 22 and to the third input of the second AND-agate 18 of the first circuit 14. The third AND-gate 22 has a second input and a third input connected with the output of the first AND-gate 17 and with the output of the comparator 16 respectively of the first circuit 14. On the output side, the third AND-gate 22 is connected to the set input "S" of the RS flip-flop 24 assigned to the opposite direction of travel. The "inverted Q" output of the RS flip-flop 24 is connected with the second input of the first AND-gate 20 of the second circuit 15 assigned to the opposite direction of travel, while the "Q" output is connected to one input of the second AND-gate 21. The second input of the second AND-gate 21 is connected with the input line a' connected to the second circuit 15 assigned to the opposite direction of travel for the same floor.

Designated with 25 are further AND-gates, each having two inputs, the one input of which is connected with the outputs of the storage or memory cells of the first memory RAM2'u and RAM2'd of the car call memory, and the second inputs of which are connected with the outputs of the OR-gates 23 of the each respective second circuit 15. The outputs of the further AND-gates 25 are connected with the drive control, where the satisfied AND-condition is interpreted as a travel command to the respective floor. The logical linkage described with the aid of FIG. 3 can be formed by the microprocessor of the microcomputer system 5, based on a program, at every position of the selector R3 for the respective floor.

The method of operation of the group control described in the preceding will be explained in more detail with the aid of FIGS. 2 and 3. In a manner similar to the European Patent Application No. A 0 246 395, an operating cost calculation is triggered on input of a call in all elevators of the group while using the load values stored in the load memory 13, and carried out at every floor designated by the scanner R1. The operating costs calculated hereby are stored for each floor in the cost memory RAM4. A cost comparison cycle is performed after the completion of a cost calculation cycle. In the comparison cycle, the operating costs stored in the cost memories of all elevators of the floors designated in each case by the second scanner R2 are compared with each other and the respective call assigned to that car which exhibits the lowest operating costs.

Let it now be assumed that on the first comparison after the input of a call, the upward travel calls entered at the floors E2, E3 and E5 are assigned to the elevator "A". These calls are stored in the further memories RAM2.2, RAM2.3 and RAM2.5 and are transferred into the first memory RAM2' of the car call memory RAM2 and the assignment is fixed and final. Let it be assumed furthermore, that the cars 2 are designated for a maximum load ($L_{max}$) of twelve persons, and that at the stop of car 2 of the elevator at floor F3, a passenger is boarding who has not entered a call. As described in the preceding, the load memory 13 is corrected in this case, while the load values of the floors E3–E10 are increased by one person. One continuation of the travel in the upward direction and progressive step-switching of the selector R3 to the address of the floor E5, the assigned first circuit 14 is activated with a load value of thirteen persons being established, and the comparator 16 generates a logic signal "1" because the load value exceeds the maximum load. On account of the NOT-gate 19, the one input and thus also the output of the second AND-gate 18 become logic "0", so that the assigned call from floor E5 cannot generate a stop signal to the drive control and the car 2 will pass by this floor.

In both the upward and downward travel directions, the circuits 14 and 15 are activated successively by means of the addresses generated by the selector R3. In doing this, the line "a'" and the connected input of the first AND-gate 20 of the second circuit 15 are set to "1" in each case for the addresses assigned to the respective floor. During the scanning of the floor E5 in an upward direction, the one input of the associated first AND-gate 20 is at the state "1", where it is assumed that the other input, due to the not set RS flip-flop 24 of the second circuits 15 of the opposite direction of travel, is likewise at "1". In this way, the output of the OR-gate 23, as well as all three inputs of the third AND-gate 22, are at the state "1", so that the respective RS flip-flop 24 is set and the bypassed call is stored in the flip-flop. Thus, the second inputs of the first AND-gates 20 of the second circuits 15 assigned to the downward direction are set to "0" by the "inverted Q" output of the upward direction flip-flop 24, whereby a scanning of the memories for downward calls is prevented for the duration of storage of the bypassed call.

It shall be assumed now that a call for floor E6 had been entered at the floor E8 (see RAM1d, RAM2'd, and RAM5d). After servicing the last call in the upward direction (floor E11) and establishment of zero load by the load measuring device 7, the car 2 will therefore start moving in downward direction. During the downward travel, the selector R3 scans the floor call memory RAM1d and the first memory RAM2'd for downward calls, where in each case the one input "a'" of the first AND-gate 20 of the second circuits 15 of the downward direction is set to "1". As follows from the preceding description however, the output of the OR-gate 23 can not be set to "1" due to the "0" at the second input of the AND-gate 20, so that the third input of the second AND-gate 18 of the first circuit 14 in each case remains in the state "0" and, as a consequence, the down calls for the floors E8 and E6 stored in the memory RAM2 will be ignored. During the downward travel, the inputs "a'" of the first AND-gates 20 of the upward direction are "0". Accordingly, the outputs of the gates 20 are at the state "0", so that an activation of the second circuits 15 of the upward direction is not possible. The car 2 will therefore also not service the up calls for the floors E9 and E7, entered on the floor E5 and stored in the first memory RAM2'u.

In the course of continued travel in the downward direction, the selector R3 switches to the address of the floor E5, whereby the output of the second AND-gate 21 and so also the output of the OR-gate 23 are set to "1". Since the car 2 is empty, the output of the NOT-gate 19 and consequently also the output of the second AND-gate 18 of the first circuit 14 will be at "1", so that the drive control can initiate the stop and the car 2 stops at the floor E5. After boarding the waiting passengers, the car 2 travels in an upward direction to the floors E7 and E9 and, after the exiting of the last passenger at the floor E11, due to the call at the floor E8, again travels downward. After servicing the floor E5, the assigned RS flip-flop 24 for the upward direction had been reset so that the second inputs of the first AND-gates 20 of the second circuits 15 of the downward direction are at the state "1". Thus, the second circuits 15 can again be activated by the addresses generated by the selector R3. On switching to the address of the floor E8 and "a'" being at "1", the outputs of the first AND-gate 20, the OR-gate 23 and the second AND-gate 18 are set to "1", so that the stop is initiated and the car 2 stops at the floor E8.

In accordance with the provisions of the patent statutes, the present invention has been described in what is considered to represent its prepared embodiment. However, it should be noted that the invention can be practiced otherwise than as specifically illustrated and described without departing from its spirit or scope.

What is claimed is:

1. A group control for elevators with load-dependent control of the cars, including call registering devices arranged on the floors by means of which calls for desired floors of destination can be entered, floor and car call memories assigned to the elevators of the group, which memories are connected with the call registering devices where at the input of calls at a floor a call characterizing the floor of input is stored in the floor call memory and the calls characterizing the floors of destination are stored in the car call memory, load measuring devices provided in the cars of the group of elevators which are connected with load memories, selectors assigned to each elevator of the group indicating in each case the floor of a possible stop, first and second scanners assigned to each elevator of the group exhibiting for each floor at least one position, a device whereby the entered calls of the cars are assigned to the group of elevators and having for each elevator a computer and a comparison device and the computer calculates at every floor designated by the first scanner from data specific to the elevator operating costs corresponding to the waiting times of the passengers, and having an assignment memory and a cost memory and the operating costs of all cars at every position of the second scanner are compared with each other by means of the comparison device and the respective call is assigned to that car which exhibits the smallest operating coats by storage in the assignment memory, and an overload control device comprising:

first circuits assigned to the floors serviced by an elevator car and connected with a selector, a load memory, an assignment memory and a floor call memory, said first circuits being activated at every position of the selector for preventing the car from servicing an assigned call if at a stop at the associated floor an overload would be generated in the car; and second circuits assigned to the upward and downward directions for the floors and connected with the selector and said first circuits, said second circuits being connected with each other and activated at every position of the selector, whereby after passing of said associated floor and reaching the point of reversal of the direction of travel, the car travels back to said associated floor without interruption and correspondingly services said assigned call entered there.

2. The group control according to claim 1 wherein said first circuits each include a comparator, a first AND-gate having two inputs, a second AND-gate having three inputs, and a NOT-gate, said first AND-gate is connected on the input side with the outputs of the respective memory cells of the floor call memory and the assignment memory and on an output side with a second input of said second AND-gate, a third input of said second AND-gate is connected with the selector, and said comparator is connected by way of one input with the load memory while a load limit value is applied to a second input, an output of said comparator being connected with one of said second circuits and an input of said NOT-gate, and an output of said NOT-gate connected with one input of said second AND-gate.

3. The group control according to claim 2 wherein said second circuits each have include a first and a second AND-gate each having two inputs, a third AND-gate having three inputs, an OR-gate having two inputs and an RS flip-flip, said first AND-gate of said second circuit being connected at one input with the selector and at an output with one input of said ORgate, a second input of said OR-gate is connected with an output of said second AND-gate of said second circuit, an output of said OR-gate is connected to one input of said third AND-gate and to said third input of said second ANDgate of said first circuit, said third AND-gate being connected at a second input with the output of said first AND-gate of said first circuit and at a third input with the output of said comparator of said first circuit and at an output with a set terminal of said RS flip-flop, an output of said RS flip-flop being connected with the second inputs of said first AND-gate of said second circuits assigned to the opposite direction of travel, and an inverting output of said RS flip-flop connected wtih one input of said second AND-gate of said second circuit, a second input of said second AND-gate of said second circuit being connected to one input of said first AND-gate of said second circuit of the same floor assigned to the opposite direction, whereby on activation of said second circuit assigned to the nonserviced said assigned call, said RS flip-flop is set, and the floor and car call memories assigned to the opposite direction cannot be scanned by means of the selector, so that during the return travel in the opposite direction, only said second circuit associated with the non-serviced assigned call will be activated and at said output of said second AND-gate of the associated first circuit a travel command for the respective floor will be generated.

4. The group control according to claim 3 wherein said first and said second circuits are formed by a program in a computer.

5. A group control for elevators with load-dependant control of elevator cars comprising:

call registering devices positioned on floors for entering calls for desired floors of destination; load measuring devices in elevator cars;

a floor call memory for storing a call characterizing the floor at which a call is entered and a call call memory for storing a call characterizing a floor of destination, said floor and car call memories being connected to said call registering devices;

a load memory connected to said load measuring devices for storing a car load value for each floor;

a first circuit connected to said floor call memory, said car call memory, and said load memory and activated for each floor of a possible stop for preventing the associated car from servicing an assigned call if a stop at the associated floor would generate an overload in the car; and a second circuit connected to said first circuit for causing the car to travel back to said associated floor without interruption and service said assigned call after passing said associated floor and reversing the direction of travel.

6. The group control according to claim 5 wherein said first circuit includes a comparator having one input connected to the outputs of the memory cells of said load memory and a second input connected to a source of a maximum car load signal and an output connected to said second circuit, a first AND-gate having one input connected to the outputs of said floor call memory and a second input connected to the outputs of an assignment memory for storing assigned calls and an output connected to said second circuit and to a second input of a second AND-gate, said second AND-gate having a first input connected to an output of a NOT-gate and a third input connected to said second circuit and an output for generating a control signal to a drive control for the elevator car, said NOT-gate having an input connected to said output of said comparator.

7. The group control according to claim 5 wherein said second circuit includes for each direction of travel a first AND-gate having one input connected to a source of a selector signal for one direction of travel and an output connected to one input of an OR-gate, a second AND-gate having one input connected to an output of an RS flip-flop and a second input connected to a source of a selector signal for an opposite direction of travel and an output connected to a second input of said OR-gate, a third AND-gate having one input connected to an output of said OR-gate and a second input connected to said first circuit and a third input connected to said first circuit and an output connected to a set input of said RS flip-flop, said RS flip-flop having a second output connected to a first input of an AND-gate of said second circuit for said opposite direction of travel.

8. In an elevator system including call registering devices arranged on floors to be serviced, at least two cars for servicing calls at the floors, floor and car call memories assigned to the cars and connected to the call registering devices for storing a call representing the floor of input and a call representing the floor of destination respectively, load measuring devices in the cars connected to load memories, selectors for each car for indicating a floor of a possible stop, a control and comparison device connected to a scanner and to the floor and car call memories and to the load memories for assigning an entered call to a car, an assignment memory connected to the control and comparison device for storing the assigned call, the improvement comprising:

a first circuit connected to the selector, the load memory, the assignment memory and the floor call memory and activated at every position of the selector for preventing the car from servicing the assigned call if a stop at the associated floor by the car would generate an overload in the car; and a second circuit connected to the selector and to said first circuit and activated at every position of the selector for preventing the car from servicing other assigned calls after passing said associated floor and reversing the direction of travel until said assigned call is services by the car.

* * * * *